US007637112B2

(12) United States Patent
Vanden Bussche et al.

(10) Patent No.: US 7,637,112 B2
(45) Date of Patent: Dec. 29, 2009

(54) HEAT EXCHANGER DESIGN FOR NATURAL GAS LIQUEFACTION

(75) Inventors: Kurt M. Vanden Bussche, Lake in the Hills, IL (US); Phillip F. Daly, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 350 days.

(21) Appl. No.: 11/610,589

(22) Filed: Dec. 14, 2006

(65) Prior Publication Data

US 2008/0142204 A1 Jun. 19, 2008

(51) Int. Cl.
*F17C 9/02* (2006.01)
*F25J 3/00* (2006.01)
*F28F 3/08* (2006.01)

(52) U.S. Cl. ..... 62/50.2; 62/903; 165/167

(58) Field of Classification Search ..... 165/167; 62/50.2, 903

See application file for complete search history.

(56) References Cited

U.S. PATENT DOCUMENTS

| | | | | | |
|---|---|---|---|---|---|
| 2,616,671 | A * | 11/1952 | Wakeman | 165/167 |
| 4,130,160 | A | 12/1978 | Dziedzic et al. | |
| 4,249,595 | A * | 2/1981 | Butt | 165/110 |
| 4,744,414 | A * | 5/1988 | Schon | 165/167 |
| 5,144,809 | A * | 9/1992 | Chevalier et al. | 165/166 |
| 5,904,205 | A * | 5/1999 | Grenier et al. | 165/166 |
| 6,167,952 | B1 | 1/2001 | Downing | |
| 6,367,286 | B1 | 4/2002 | Price | 62/613 |
| 6,564,578 | B1 | 5/2003 | Fischer-Calderon | 62/613 |
| 6,742,358 | B2 | 6/2004 | Wilkinson et al. | 62/613 |
| 6,763,680 | B2 | 7/2004 | Fischer et al. | 62/612 |
| 6,886,362 | B2 | 5/2005 | Wilding et al. | 62/613 |
| 6,953,009 | B2 | 10/2005 | Reinke et al. | |
| 6,959,492 | B1 * | 11/2005 | Matsumoto et al. | 29/890.039 |
| 7,343,965 | B2 | 3/2008 | Memory et al. | |
| 2001/0030043 | A1 * | 10/2001 | Gleisle et al. | 165/167 |
| 2003/0015310 | A1 | 1/2003 | Dienhart et al. | |
| 2005/0039898 | A1 * | 2/2005 | Wand et al. | 165/167 |
| 2007/0028627 | A1 * | 2/2007 | Moracchioli et al. | 62/50.2 |

FOREIGN PATENT DOCUMENTS

| | | | |
|---|---|---|---|
| EP | 0136481 | A2 | 4/1985 |
| EP | 0503080 | B1 | 9/1992 |
| GB | 2218794 | A | 11/1989 |
| GB | 2249621 | A | 5/1992 |
| JP | 62-206380 | A | 9/1987 |
| WO | WO 91/51830 | | 2/1992 |

* cited by examiner

*Primary Examiner*—William C Doerrler
(74) *Attorney, Agent, or Firm*—Arthur E. Gooding

(57) ABSTRACT

An inexpensive heat exchanger is disclosed, wherein the heat exchanger is made up of a plurality of plates and each plate has at least one channel defined in the plate. The plates are stacked and bonded together to form a block having conduits for carrying fluids, and where each fluid is in thermal communication with the other fluids.

2 Claims, 11 Drawing Sheets

HEAT EXCHANGER DESIGN FOR NATURAL GAS LIQUEFACTION

FIELD OF THE INVENTION

The present invention relates to the cooling and liquefaction of gases, and more particularly to the liquefaction of natural gas.

BACKGROUND OF THE INVENTION

The demands for natural gas have increased in recent years. The transport of natural gas is through pipelines or through the transportation on ships. Many areas where natural gas is located are remote in the sense that there are no convenient pipelines to readily transfer the natural gas to. Therefore natural gas is frequently transported by ship. The transport of natural gas on ships requires a means to reduce the volume and one method of reducing the volume is to liquefy the natural gas. The process of liquefaction requires cooling the gas to very low temperatures. There are several known methods of liquefying natural gas as can be found in U.S. Pat. No. 6,367,286; U.S. Pat. No. 6,564,578; U.S. Pat. No. 6,742,358; U.S. Pat. No. 6,763,680; and U.S. Pat. No. 6,886,362.

One of the methods is a cascade method using a shell and tube heat exchanger. The apparatus, the shell and tube heat exchanger, is very large and very expensive, and presents problems of economics and feasibility for remote and smaller natural gas fields. It would be desirable to have a device for liquefying natural gas that is compact and relatively inexpensive to ship and use in remote locations, especially for natural gas fields found under the ocean floor, where collection and liquefaction of the natural gas can be performed on board a floating platform using a compact unit.

SUMMARY OF THE INVENTION

The invention is a block heat exchanger comprising a plurality of plates that have been stacked and bonded together into a single block. Within the plates open channels have been formed for carrying fluids. The channels form conduits when the plates are stacked and bonded together, and the open channels are covered by a side of a neighboring plate that is in sealing contact, forming a lightweight and compact heat exchanger.

In another embodiment, the heat exchanger comprises plates having channels defined therein, and with the channels inlets and outlets disposed upon an edge of a plate. The plates when stacked form a block having covered channels, or conduits, traversing through the block for carrying fluids. An individual channel in this embodiment does not cross between plates, but is disposed within a single plate. The plates have a channel side and a non-channel side, and are stacked such that a channel side of one plate is in sealing contact with the non-channel side of a neighboring plate.

Additional objects, embodiments and details of this invention can be obtained from the following detailed description of the invention.

DETAILED DESCRIPTION OF THE INVENTION

Figure 1:
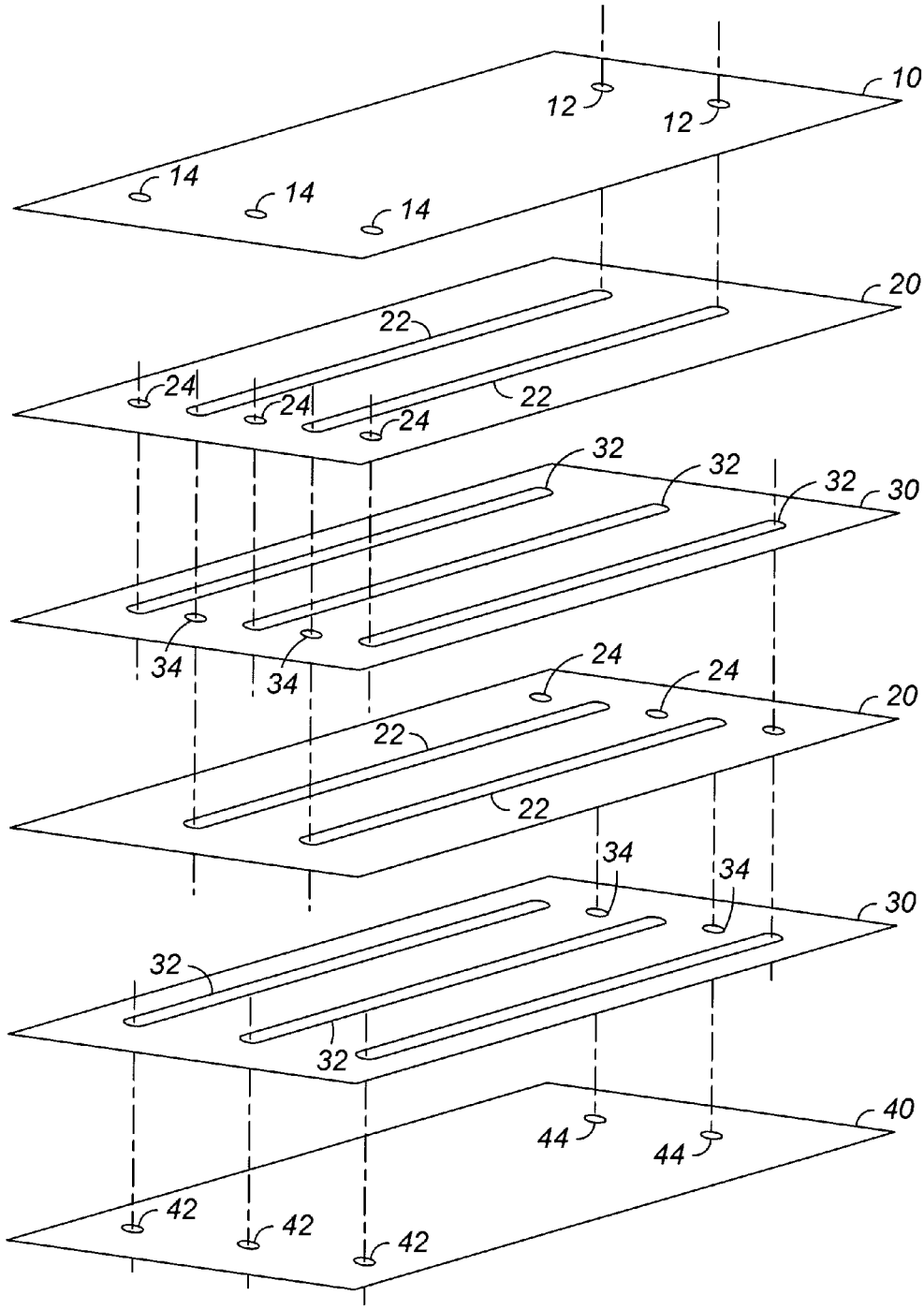
FIG. 1 is a schematic of a simplified version of one embodiment.

The use of liquefied natural gas (LNG) is increasing, as fuel and a means of transporting natural gas from remote sites having natural gas, without a nearby gas pipeline, to more distant areas where the natural gas is consumed. Natural gas is typically recovered from gas wells that have been drilled and is in the gas phase at high pressure. The present invention is directed to a heat exchanger for cooling the natural gas at the gas wells. By providing an inexpensive heat exchanger for cooling and liquefying natural gas in remote locations, natural gas can be recovered on site and transported as LNG, rather than requiring a natural gas pipeline, or transporting the gas at very high pressures.

The basic invention comprises a novel design using the bonding of plates together to form a single unit. Each of the plates has channels formed in the plates, by etching, milling, or methods known in the art. When the plates are bonded together, the channels are covered and form conduits through which fluids can flow. The bonding method will depend on the materials of construction, such as with aluminum plates, bonding involves brazing the aluminum plates together. With steel, diffusion bonding can be performed to bond the steel plates together.

The most common commercial design of a heat exchanger for the cooling of natural gas is a spiral wound heat exchanger where the coolant cascades within a shell over spiral wound tubes carrying the gas to be cooled. Benefits of the present design over the spiral wound design include lower cost, lower weight, and a more compact structure as well as improved heat transfer characteristics.

An apparatus for heat exchange between fluids is fabricated from a plurality of first plates having channels defined therein for carrying a fluid to be cooled. Each channel has an inlet and an outlet, and each plate has channeling ports passing through the plates. The plates each have an upper and lower face, with the channels defined in the upper face. The apparatus further includes a plurality of second plates having channels defined therein for carrying a coolant. Each channel has an inlet and an outlet, and each plate has channeling ports passing through the plates. The second plates each have an upper and lower face, with the channels defined in the upper face. The plates are stacked in an alternating manner—first plate, second plate, first plate, second plate, etc.—wherein a first plate upper face is in sealing contact with a second plate lower face, and a second plate upper face is in sealing contact with a first plate lower face. When the plates are stacked, the channels become covered conduits.

Another method of fabricating the apparatus does not require ports for fluids to pass from channels in one plate to channels in another plate, but the plates are fabricated to have the entire channel defined within a plate, and the inlets and outlets to the channels are disposed along an edge of the plate. The plates have a channel side, or first side, and a non-channel side or second side. The plates would consist of coolant plates for carrying coolant, and cooling plates for carrying fluids to be cooled. The plates are stacked in an alternating sequence to provide the maximum thermal contact between the plates. The plates are stacked such that the first side, or channel side, of one plate is in sealing contact with the second side, or non-channel side, of a second plate, where the channels become covered conduits with the inlets and outlets to the channels disposed along edges of the plates.

The invention is further illustrated by the following descriptions of specific embodiments.

In one embodiment, the apparatus, as shown in FIG. 1, comprises a first exterior plate 10 having ports defined in the plate 10 positioned upon a stack of interior plates 20, 30. The interior comprises second plates 20 and third plates 30 which are stacked in an alternating order—second, third, second, third. The ports on the first plate 10 include inlet ports 12, and outlet ports 14 disposed on the first plate 10. The second plate 20 includes channels 22 defined in the second plate 20 and in fluid communication with the inlet ports 12 on the first plate 10. The second plate 20 further includes channeling ports 24 defined in the second plate 20 and in fluid communication with the outlet ports 14 on the first plate 10. The third plate 30 includes channels 32 defined in the plate 30 and in fluid communication with the channeling ports 24 of the second plate 20. The third plate 30 further includes channeling ports 34 defined in the third plate 30 to and in fluid communication with the channels 22 of the second plate 20. The exterior comprises a fourth plate 40 disposed on a face of the stacked plates opposite the first exterior plate 10, and includes inlet ports 42 and outlet ports 44 defined in the plate 40.

Upon stacking the plates, first exterior plate 10, interior second plate 20, interior third plate 30, etc., and finally exterior plate 40, a block is formed when the plates are diffusion bonded together. Within the block, there is defined a first set of contiguous conduits comprising the channels 22 defined in the second plates 20 and in fluid communication with one another through the channeling ports 34 defined in the third plates 30. Additionally there is a second set of contiguous conduits comprising the channels 32 defined in the third plates 30 and in fluid communication with one another through the channeling ports 24 defined in the second plates 20.

The first set of contiguous conduits provide at least one fluid conduit for the transport of a fluid to be cooled. The second set of contiguous conduits provide fluid conduits for a coolant. In the embodiment as shown in FIG. 1, the two contiguous conduits beginning at inlet ports 12, following channels 22, through channeling ports 34 and exiting outlet ports 44 provide for the transport of coolant. The coolant can be delivered to the two inlet ports 12 through a manifold (not shown) that distributes the coolant. The three contiguous conduits beginning at inlet ports 42, following channels 32, through channeling ports 24 and exiting outlets 14 provide for the transport of three separate fluids, for simultaneous cooling of the three streams.

Figure 2:
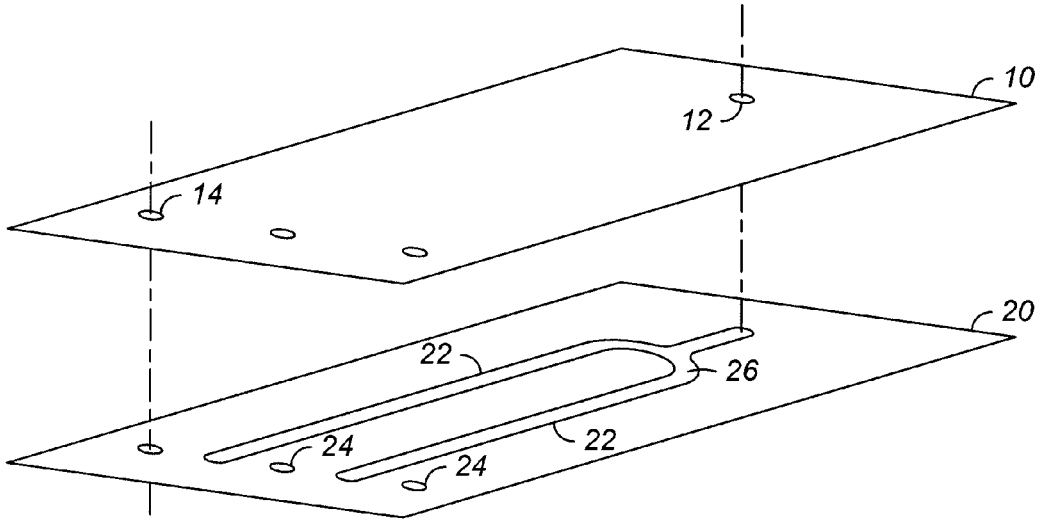
FIG. 2 is a diagram of plates with a single port and a split channel.

In an alternative embodiment, a fluid to be cooled can be directed through multiple channels through a bifurcation defined in a plate. As shown in FIG. 2, a single inlet port 12 provides access to two channels 22 defined in plate 20 through a bifurcation 26 defined in the plate 20. The use of a bifurcation 26 to two or more channels enables the distribution of the fluid through a single port 12 to be distributed and provide greater surface area for heat transfer.

Figure 3:
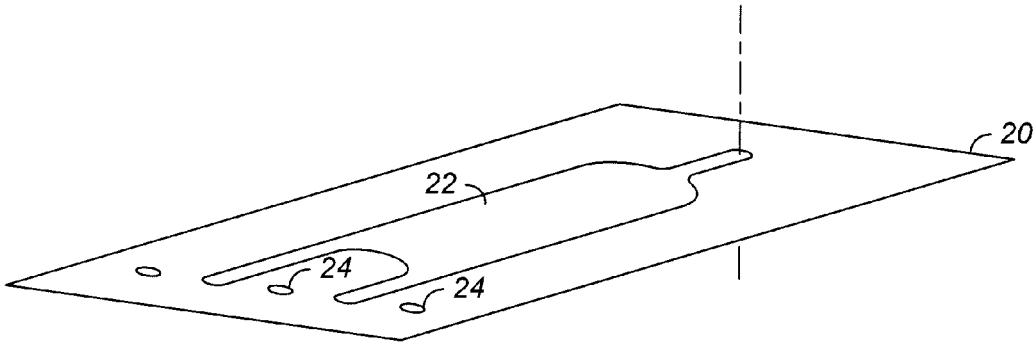
FIG. 3 is a diagram of an interior plate having a wide channel.

Multiple channels 22 can also be combined into single broad channels as shown in FIG. 3. Broader channels improve characteristics such as pressure drop and distribution of the coolant, or of a fluid to be cooled within the heat exchanger.

The design can include intermediate drawoff ports for drawing off the natural gas and passing the natural gas through an adsorbent unit for removing water, carbon dioxide, and other undesired components in the natural gas to create a dry, enriched natural gas stream. With the use of an intermediate drawoff for passing the natural gas through an adsorbent unit, the design would include intermediate inlet ports for entering the dried natural gas stream into the heat exchanger.

Figure 4:
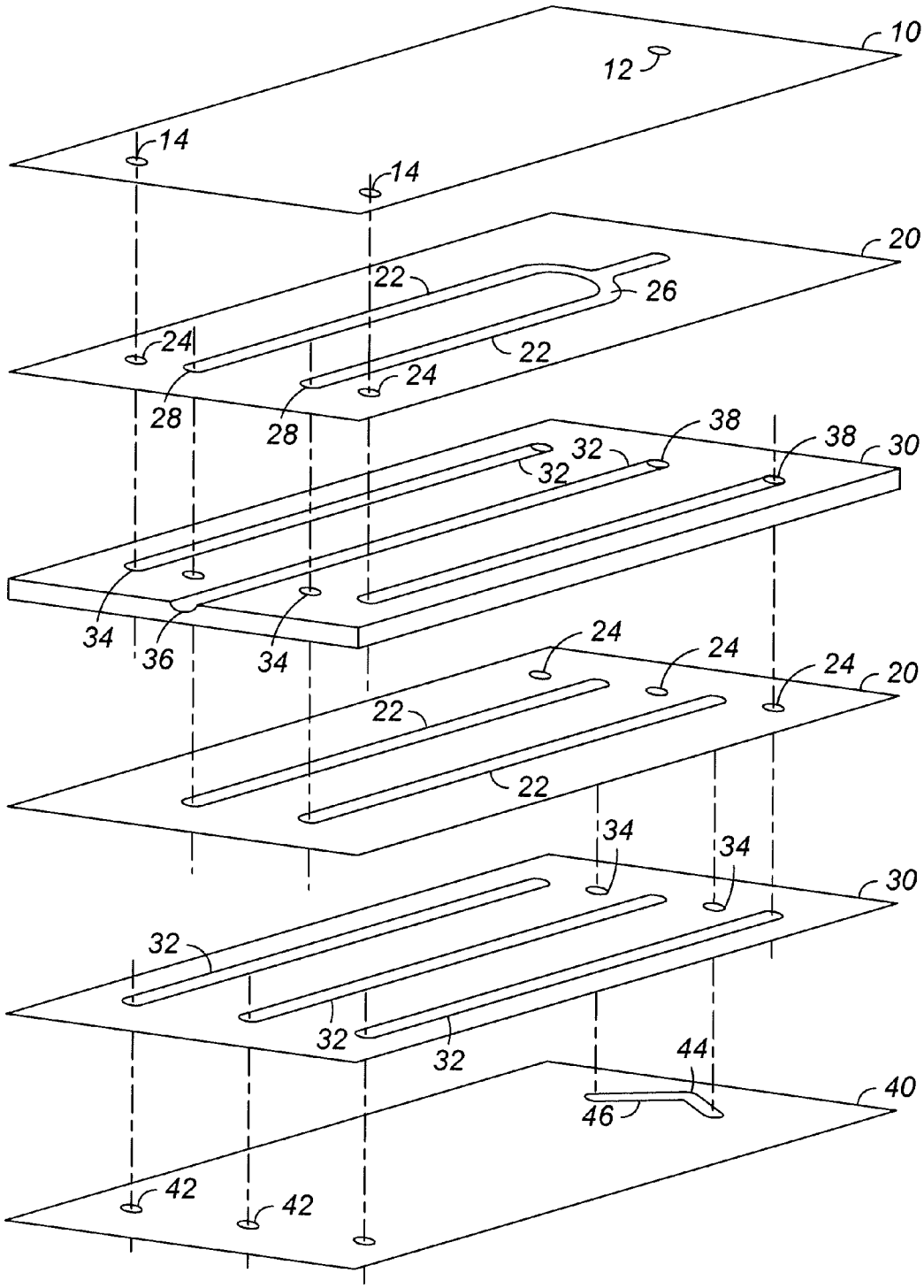
FIG. 4 is a schematic of a second embodiment.

A second embodiment is shown in FIG. 4. The heat exchanger comprises cooling plates 20 for carrying a fluid to be cooled, alternating with coolant plates 30 for carrying a coolant. The cooling plates 20 define channels 22 for carrying the fluid to be cooled, and ports 28 for the egress of the fluid being cooled. The cooling plates 20 include connecting ports 24 for passing coolant through the coolant plate 20 from one coolant plate 30 to a second coolant plate 30. The coolant plates 30 define channels 32 for carrying coolant and ports 38 for the egress of the coolant. The coolant plates 30 include connecting ports 34 for passing the fluid to be cooled through the coolant plate 30 from one cooling plate 20 to a second cooling plate 20. A cooling plate 20 can include a bifurcating channel 26 for distribution a fluid to a plurality of channels 22. The second embodiment further includes a top plate 10 having in inlet port 12 for admitting a fluid to be cooled, and exit ports 14 for the egress of coolant. A bottom plate 40 can be added for merging fluid streams having a collection channel 46.

A fluid to be cooled enters through an inlet port 12, traverses along channels 22, through connecting ports 34, and exits through outlet port 44. A coolant enters through inlet ports 42, traverses along channels 32, through connecting ports 24, and exit outlet ports 14, or an intermediate outlet port 36. Optionally, a coolant can enter through a single port 42, traverse through one set of channels 32, and connecting ports 24, exiting one outlet port 14, whereby the coolant is passed through an expander (not shown), further cooling the coolant. The expanded coolant is directed back to the heat exchanger through a second coolant inlet port 42, traverses through a second set of channels 32, and connecting ports 24, and exiting a second outlet port 14. Another option, is to pass the expanded coolant in a reverse direction, entering through a port 14 or 36 and exiting at port 42.

Figure 5:
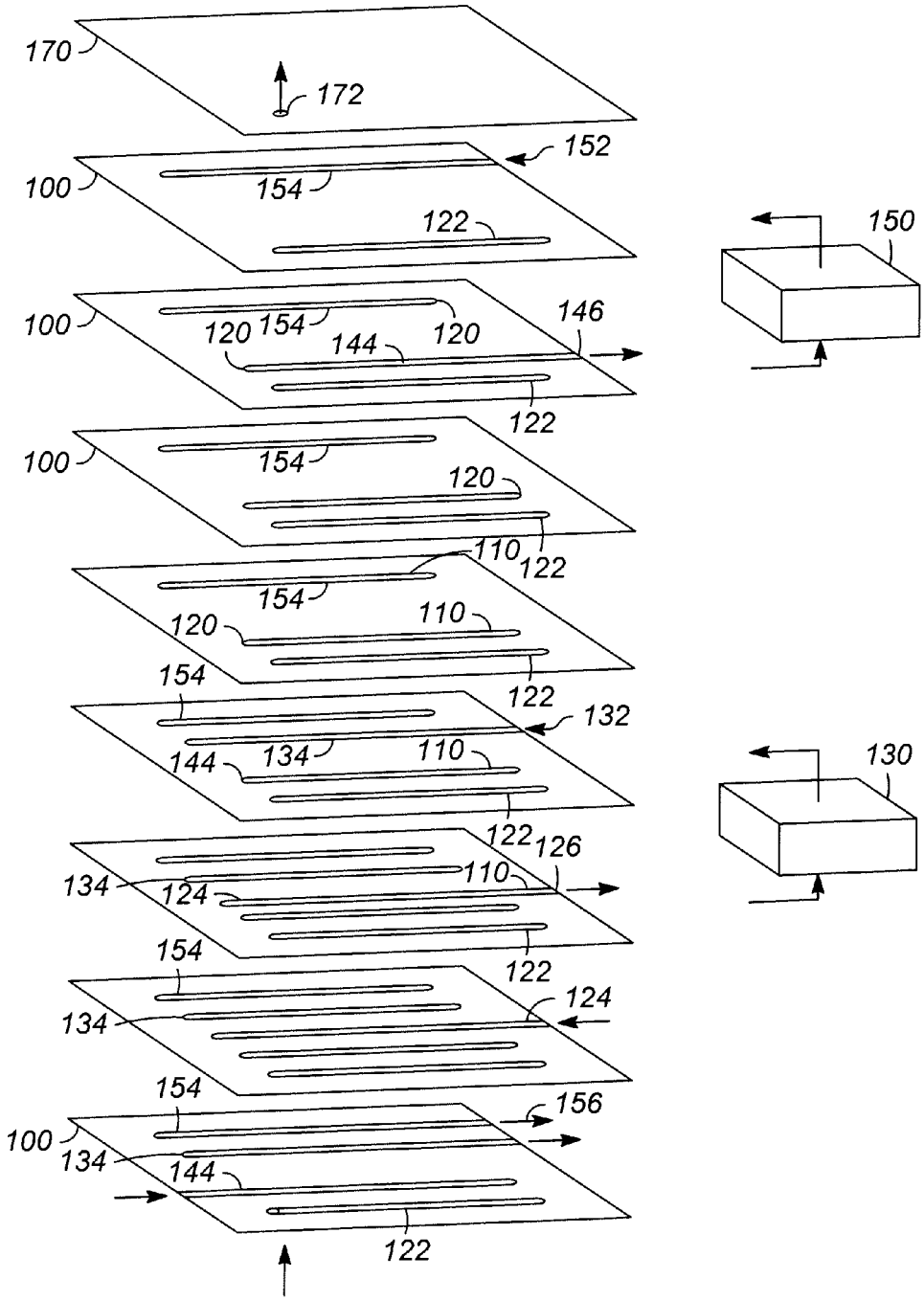
FIG. 5 is a schematic of a third embodiment.

A third embodiment of the heat exchanger is shown in FIG. 5. The exchanger comprises a plurality of plates 100, wherein each plate 100 has channels 110 and ports 120 defined therein. The plates 100 when stacked and bonded together form a solid block having a plurality of conduits that traverse through the block. The conduits are formed from a series of channels 110 in fluid communication with one another. Each conduit can span more than one plate, wherein each conduit comprises at least one channel 110. When a conduit spans more than a single plate, the conduit comprises multiple channels 110 that are in fluid communication through ports 120. At least one conduit 122, in the present embodiment, carries a fluid to be cooled. In the present invention the fluid to be cooled is natural gas. A first coolant stream is injected into a first coolant conduit 124. The first coolant stream travels in a con-current direction relative to the fluid being cooled, picking up heat from the stream to be cooled. The first coolant stream is withdraw from the first coolant conduit 124 at an outlet 126, and passed to a first expander 130, wherein the first coolant stream is expanded and cooled. The cooled first coolant stream reenters the heat exchanger at a second inlet 132 for the first coolant and flows through a second coolant conduit 134 in a counter-current direction relative to the fluid stream to be cooled.

A second coolant stream is injected into a third coolant conduit 144 and travels in a con-current direction relative to the fluid to be cooled. The second coolant stream is withdrawn from an outlet 146 where the second coolant is passed to a second expander 150, wherein the second coolant stream is expanded and cooled. The cooled second coolant stream reenters the heat exchanger at an inlet port 152 and traverses along a fourth coolant conduit 154 in a counter-current direction relative to the fluid being cooled, and exiting the conduit 154 at outlet port 156.

A final plate 170 is added to the stack of plates forming the heat exchanger to enclose the channels 110 in the last plate 100 of the interior stack of plates 100. The final plate 170 can include a port 172 for the outlet of the cooled fluid. Additional cooling can be provided by cooling the coolant streams before directing the coolant streams to the respective expanders 130, 150.

The expanders 130, 150 can comprise a Joule-Thomson valve, a turbine expander, or other device for expanding the coolant and dropping the temperature of the coolant.

Figure 6:
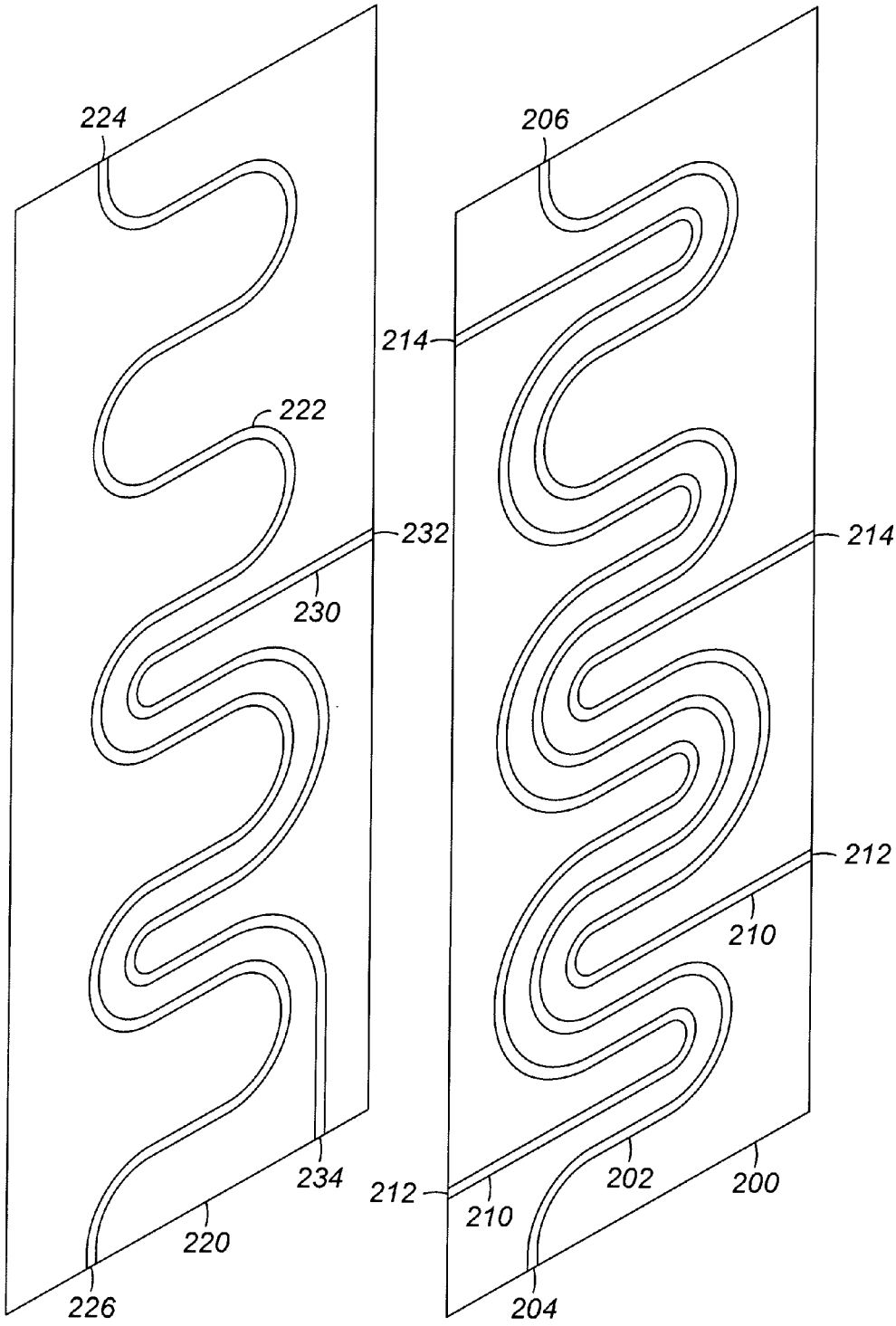
FIG. 6 is a schematic of a fourth embodiment.

A fourth embodiment of the heat exchanger is shown in FIG. 6. In this embodiment, each conduit formed in the heat exchanger is formed from a channel formed in a single plate and the channel is covered by one face of an adjoining plate. The embodiment comprises a plurality of cooling plates 200 and coolant plates 220. The plates 200, 220 are placed in an alternating sequence to maximize the thermal contact between the plates 200, 220. A cooling plate 200 includes at least one channel 202 for carrying a fluid to be cooled having an inlet 204 at one edge and an outlet 206 at another edge. The cooling plate 200 can include channels 210 for carrying coolants where each channel 210 has an inlet 212 and an outlet 214. The coolant plate 220 includes at least one channel 222 for carrying coolant, and having an inlet 224 and an outlet 226. The coolant plate 220 can include additional coolant channels 230 having an inlet 232 and an outlet 234. In one design of the present embodiment, the coolants passing through the cooling plate 200 in the coolant channels 210 are also cooled. The coolants exit the coolant channels 210 at the outlet ports 214, and are passed through expanders to further cool the coolant streams. The expanded coolant streams are directed to the inlets 224, 232 of the coolant plate 220 and flow in a counter-current direction relative to the flows in the cooling plate 200. This design provides for a cooling stream flowing through channel 230 and a second cooling stream flowing through channel 222.

When stacking the plates 200, 220, the inlets and outlets of the various channels are in fluid communication with a manifold for collecting or distributing like streams to respective like outlets or inlets. A benefit of the fourth embodiment, is that alignment of ports 120 as in the first through third embodiments is not necessary, as the conduits formed from the channels are completely defined within a single plate. This can reduce fabrication costs by removing the need for precision alignment of ports in the plates.

Figure 7:
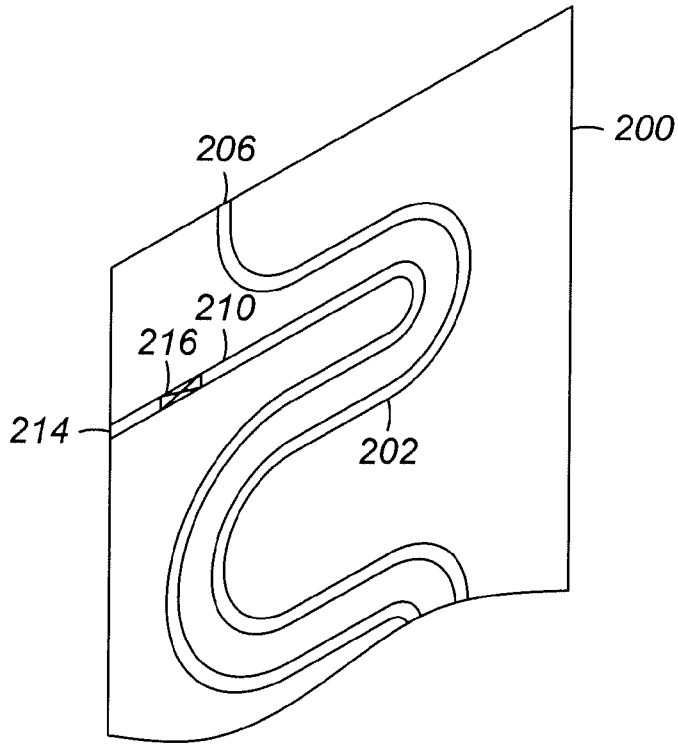
FIG. 7 shows a channel with a restriction device for expansion of a coolant.
Figure 8:
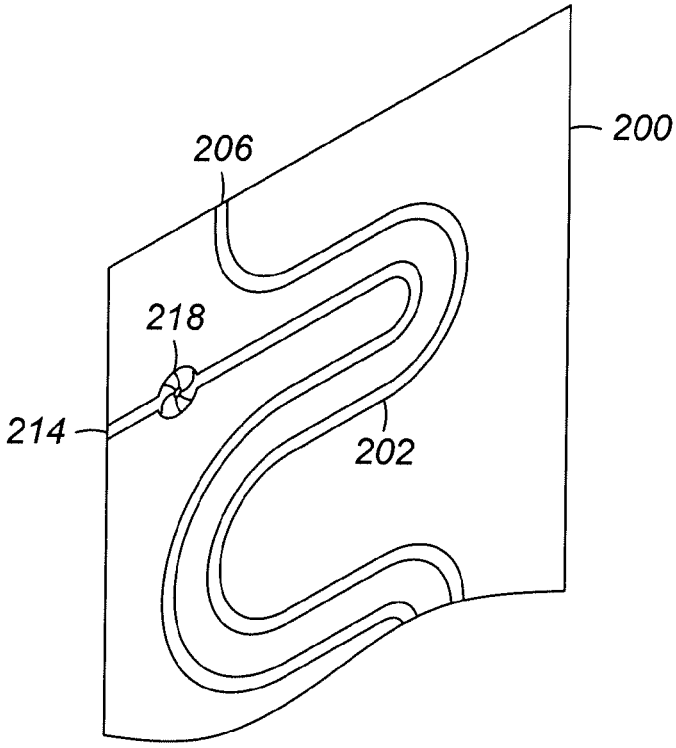
FIG. 8 shows a micro-turbine expander disposed within a channel.

In one embodiment, the apparatus can include a restriction device 216 disposed within a channel 210, as shown in FIG. 7. The restriction device 216 as shown here is disposed near the outlet 214 of a channel carrying a coolant to be expanded, and in a channel 210 that is defined in a cooling plate 200. The restriction device 216 can be a Joule-Thomson valve, or any appropriate restriction device, such as a restriction orifice, that induces a pressure drop for the coolant to expand and cool, and can be positioned in other locations, depending on an individual design. Another option for expanding the coolant is shown in FIG. 8, and comprises a micro-turbine expander 218. This provides for the expanding fluid to perform work. The micro-turbine 218 has a shaft, and with alignment of the plates 200, 220 when stacked, the shaft can be a common shaft for a plurality of micro-turbines 218, or the apparatus can be designed where a plurality of coolant channels are connected to a manifold and manifold directs the coolant to a micro-turbine.

Figure 9:
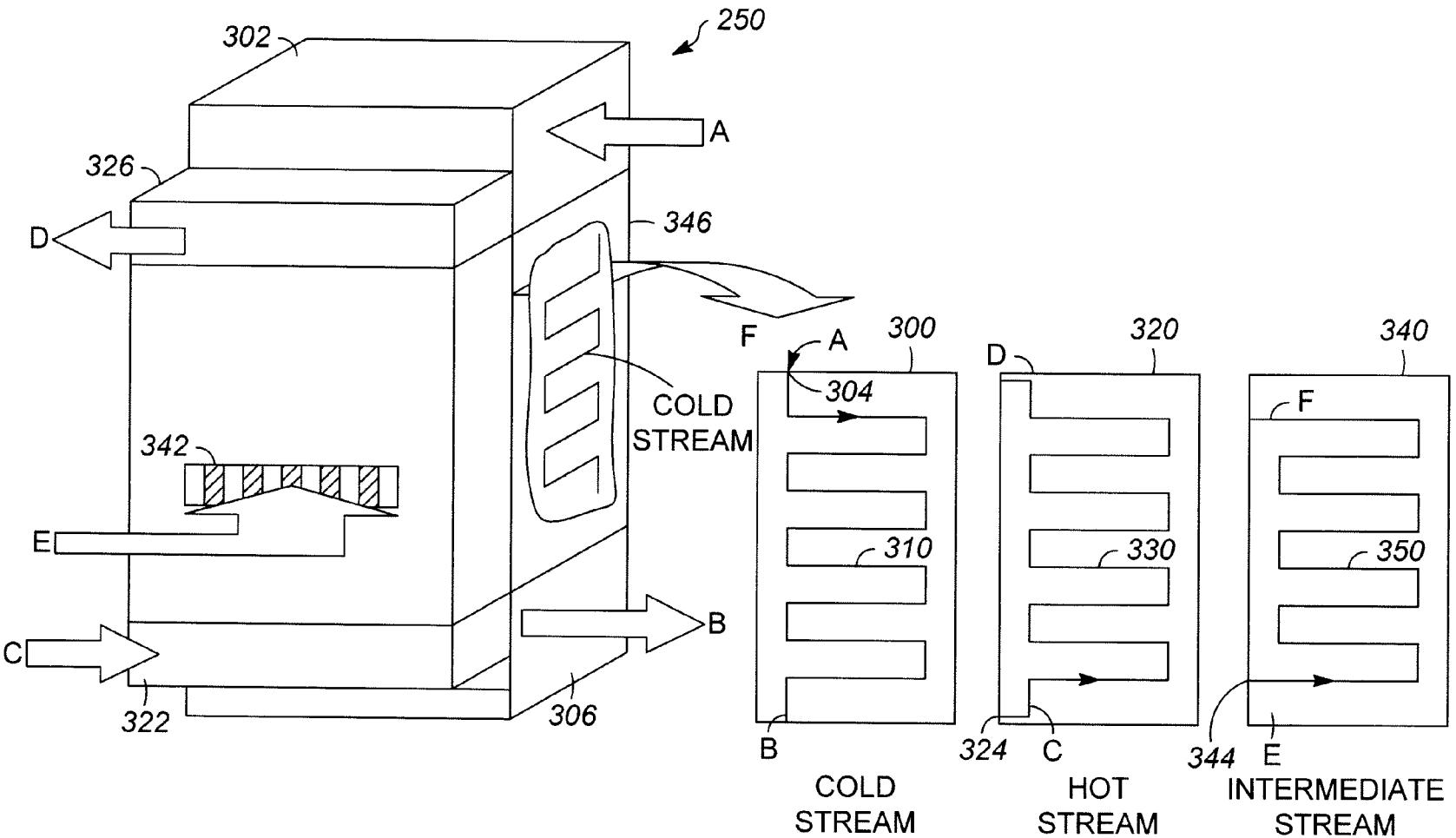
FIG. 9 shows one embodiment with single channels in each plate.

The plates that are bonded together can, also, each have a single channel etched, milled, or otherwise created in an individual plate. As shown in FIG. 9, the invention comprises a plurality of plates that are stacked and bonded together to form a single unit 250. In this embodiment, the apparatus comprises a plurality cold plates 300 each etched with a channel 310 for carrying a cold fluid; a plurality of hot plates 320 each etched with a channel 330 for carrying a hot fluid; and a plurality of intermediate plates 340 each etched with a channel 350 for carrying an intermediate temperature fluid. The plates, 300, 320, 340 are stacked, in an alternating manner to provide thermal communication between the fluids in an efficient manner. A hot fluid, in this case natural gas, enters a manifold 322 which distributes the gas to a plurality of hot stream plates 320. The gas distributes to a plurality of inlets 324 and exits the channels 330 to an outlet manifold 326.

An intermediate temperature stream enters an intermediate manifold 342 where the intermediate temperature stream is distributed to the inlets 344 of the intermediate plates 340. The stream exiting the intermediate plates 340 is collected into an intermediate manifold 346. The intermediate stream is a pre-refrigerant stream, and can be natural gas that has been pre-cooled and recycled.

A cold stream comprising a refrigerant, enters a cold manifold 302 where the refrigerant is distributed to the inlets 304 of the cold plates 300. The refrigerant passes along the cold plate channels 310 and is collected in the cold outlet manifold 306.

Figure 10:
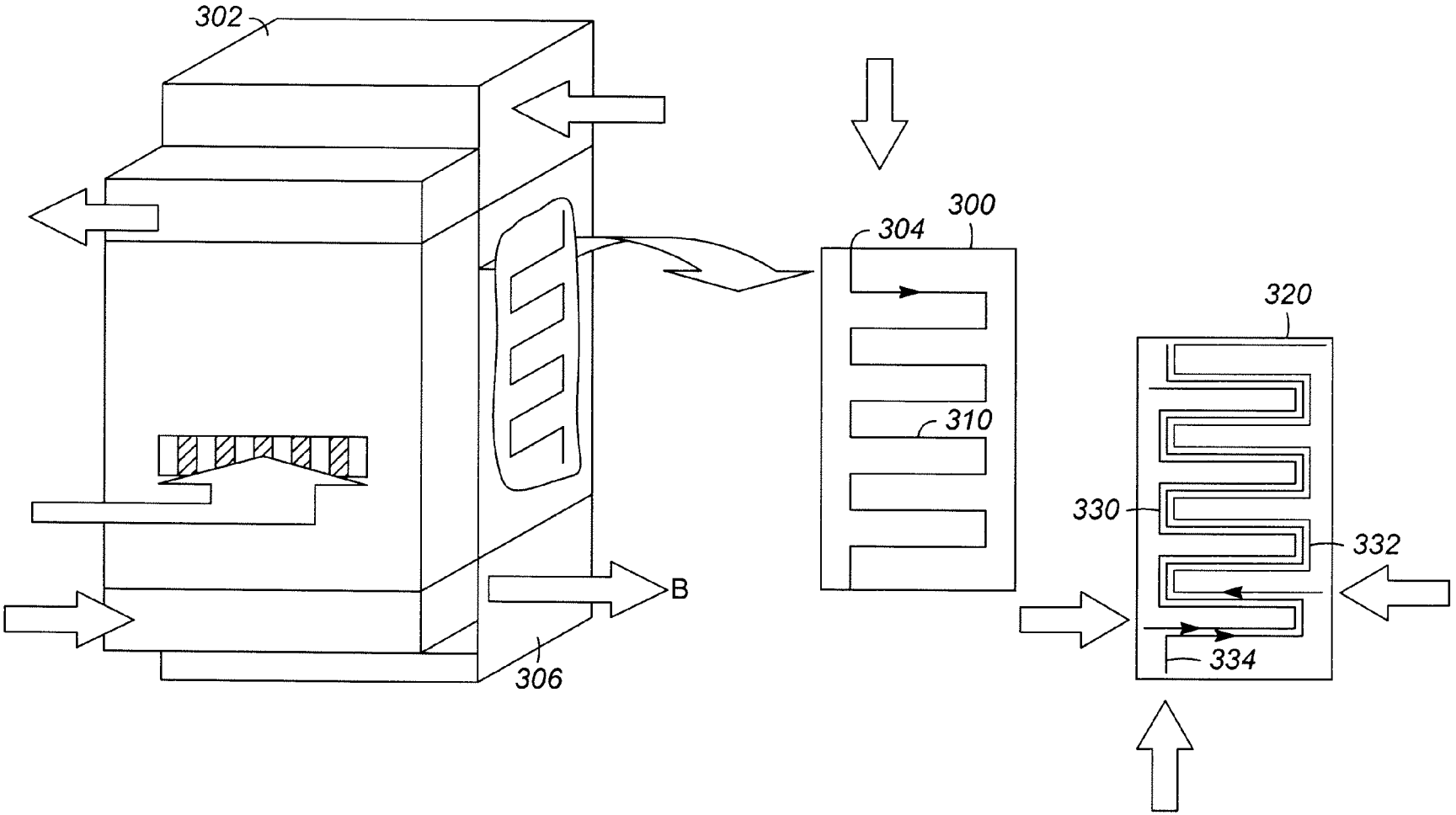
FIG. 10 shows one embodiment with multiple channels in the hot plate.

In another embodiment as shown in FIG. 10, the apparatus comprises a plurality of cold plates 300 alternating with a plurality of hot plates 320. The cold plate 300 comprises a channel 310 wherein a refrigerant is distributed through a cold manifold 302 to the cold plate inlets 304 and collected from the cold plates 300 at a cold outlet manifold 306. The hot plates comprise a plurality of channels wherein there are two hot fluid channels 330, 332 and one intermediate temperature stream channel 334.

Figure 11:
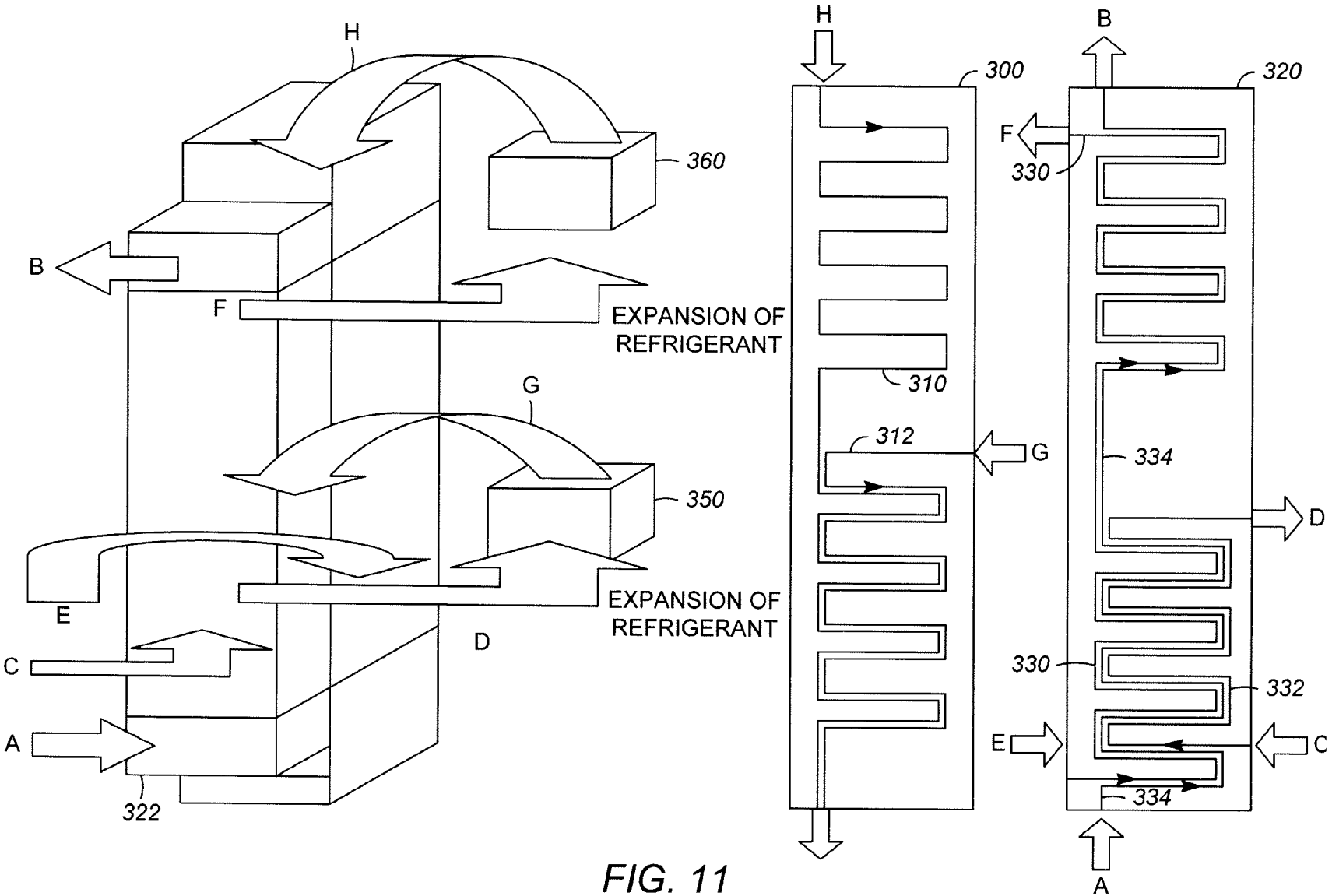
FIG. 11 shows one embodiment where multiple streams are used and intermediate expansion of refrigerant provides additional cooling.

The design of the present invention allows for variations such that refrigerant after cooling the hot natural gas can be expanded to and recycled to provide further cooling as shown in FIG. 11. In this embodiment the apparatus comprises a plurality of cold plates 300 each with multiple channels 310, 312 defined therein, and a plurality of hot plates 320 with multiple channels 330, 332 and 334 defined therein. A natural gas stream enters a hot inlet manifold 322 that distributes the gas to the hot plate channels 334 for cooling. Refrigerant is passed to the hot plates 320 and directed to cooling channels 330 and 332. One of the coolant streams from channel 332 is drawn off and expanded through an expander 350 to condense and cool the refrigerant. The expanded and cooled refrigerant is redirected to a channel 312 in the cold plate 300 to provide additional cooling. In addition, the refrigerant in the channel 330 is drawn off and passed to a second expander 360 to further cool the refrigerant. The cooled refrigerant is passed to the cold plate channel 310 to provide additional cooling of the natural gas.

Process Example

Figure 12:
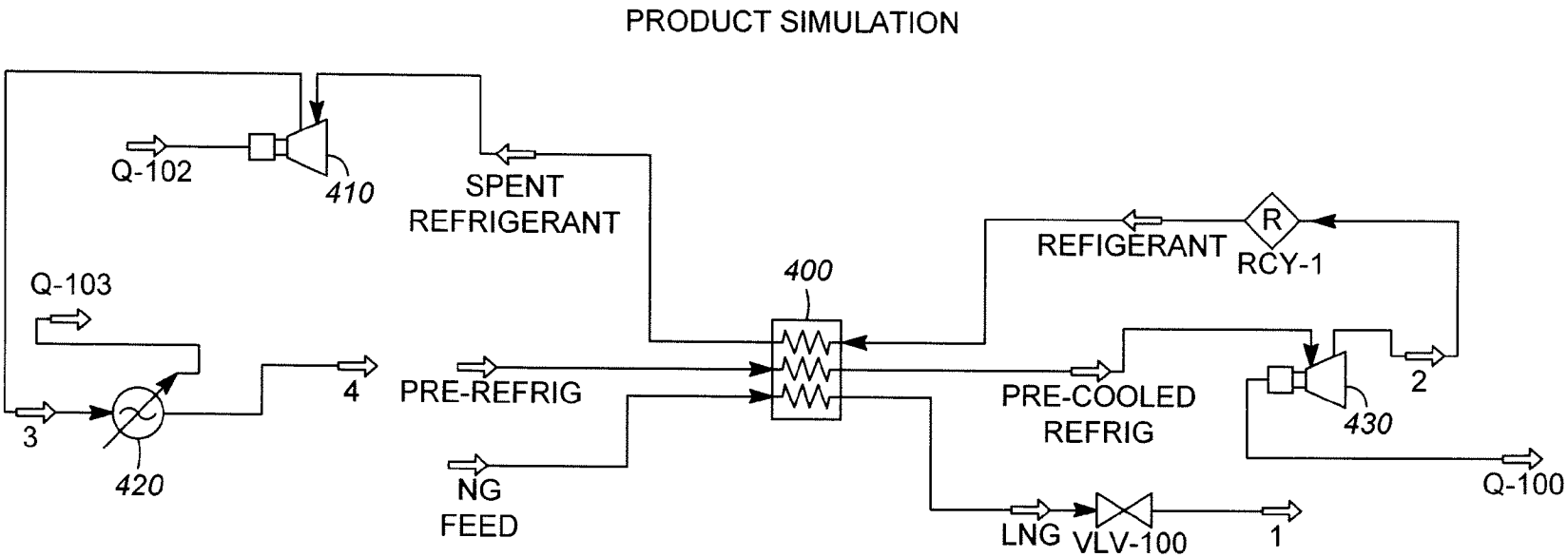
FIG. 12 is a schematic of a process using the present invention.

The use of the diffusion bonded heat exchanger of the present invention provides for optimization of natural gas liquefaction, by taking advantage of the synergies presented with this compact heat exchanger. In FIG. 12, a simplified process scheme is presented and a simulation is performed for testing design considerations. Natural gas, at about 70 atm (7.1 MPa), enters the heat exchanger 400, along with recycled refrigerant. The refrigerant is compressed with a compressor 410, to about 70 atm (7.1 MPa) and cooled against cooling water in a second heat exchanger 420 to about 15° C. generating a high pressure refrigerant stream and passed to the heat exchanger 400. The natural gas is cooled and expanded to condense the natural gas to liquid and is directed to LNG storage. The high pressure refrigerant leaving the heat exchanger 400 is expanded in an expander 430 to a temperature of about −165° C. and redirected to the heat exchanger 400 for pre-cooling the high pressure refrigerant and cooling the natural gas. The use of diffusion bonded heat exchangers allows for significant pressure differentials between the hot side and cold side of the heat exchanger 400. In this example, the differential is about 60 bars (6 MPa).

Figure 13:
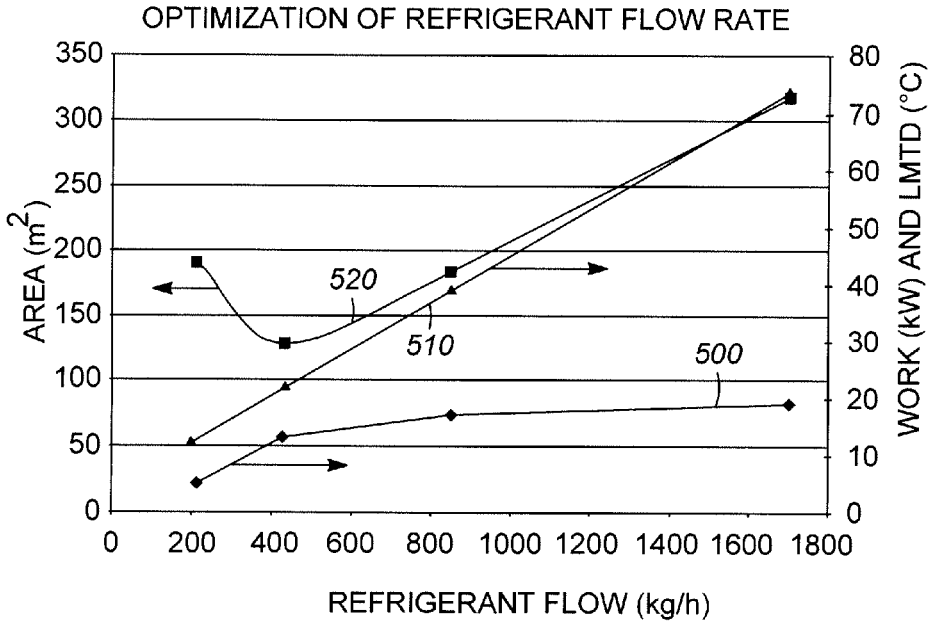
FIG. 13 shows the refrigerant flow rate vs. heat exchange area, work and log mean temperature difference.

The refrigerant is used to cool itself, by expansion and passing the expanded refrigerant back through the heat exchanger 400. This provides a temperature difference that is a driving force for cooling and allows for interesting optimization. The effect of refrigerant flow rate for this system is shown in FIG. 13. The log mean temperature difference (LMTD) 500 is indicative of the average driving forge for heat exchange. As the refrigerant flow rate increases the LMTD approaches the asymtatic value of 20° C., and the work 510 required for heat exchange increases monotonically with flow of refrigerant. The interplay of LMTD and work load leads to a minimum in surface area 520 at a refrigerant flow rate of about 400 kg/hr. This leads to design considerations for producing a heat exchanger with a minimum of capital expenditure and production of a compact heat exchanger design. If increased workload is required, then multiple heat exchangers would be preferred over larger single units.

Figure 14:
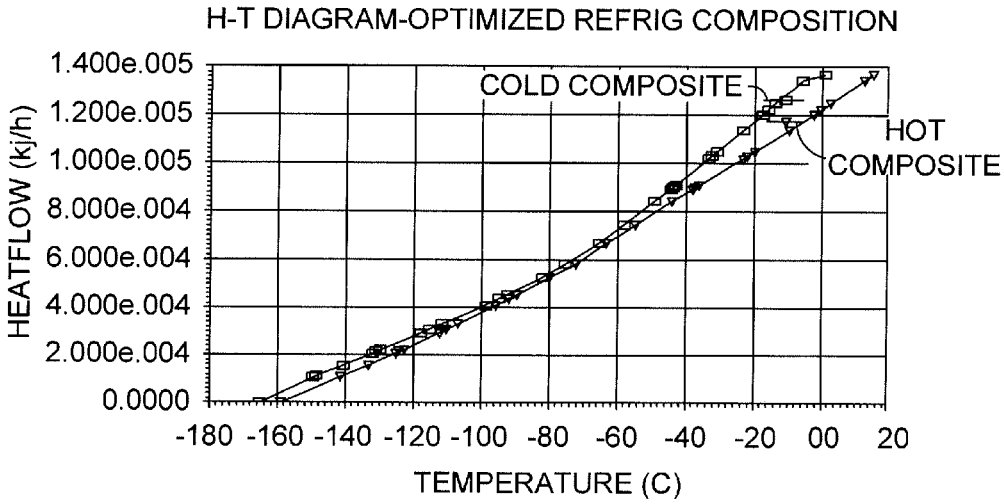
FIG. 14 is a plot of heat flow for refrigerant compositions used in simulations.

The efficiency of the heat exchanger is affected by the composition of the refrigerant. The refrigerant composition is selected to heat flow over a broad range of temperatures, and providing continuous boiling of the refrigerant over the temperature range of interest as shown in FIG. 14.

While the invention has been described with what are presently considered the preferred embodiments, it is to be understood that the invention is not limited to the disclosed embodiments, but it is intended to cover various modifications and equivalent arrangements included within the scope of the appended claims.

What is claimed is:

1. A heat exchanger comprising:

a plurality of first plates having channels defined therein with each channel having an inlet and an outlet, having channeling ports passing through the plates, and where each first plate has an upper and a lower face, wherein the first plate channels carry a fluid to be cooled;

a plurality of second plates having channels defined therein with each channel having an inlet and an outlet, having channeling ports passing through the plates, and where each second plate has an upper and a lower face, wherein the second plate channels carry a coolant;

wherein the plates are arranged in an alternating sequence where the lower face of a first plate is in sealing contact with the upper face of a second plate and the lower face of the second plate is in sealing contact with the upper face of another first plate, the channels in the first plates are in fluid communication through the channeling ports in the second plates, and the channels in the second plates are in fluid communication through the channeling ports in the first plates and wherein at least one of the first or second plates further comprises a micro-turbine disposed within a channel.

2. An apparatus for heat exchange between fluids comprising:

a plurality of first plates wherein each plate has at least one contiguous channel defined therein, each channel forming a sinuous path beginning with an inlet disposed at an edge of the plate and ending at an outlet disposed at an edge of the plate, and where each plate has a non-channel side and a channel side;

a plurality of second plates wherein each plate has at least one contiguous channel defined therein, each channel forming a sinuous path beginning with an inlet disposed at an edge of the plate and ending at an outlet disposed at an edge of the plate, and where each plate has a non-channel side and a channel side;

wherein the plates are stacked in an alternating manner, and the channel side of a first plate is in sealing contact with the non-channel side of a second plate, and the channel side of a second plate is in sealing contact with the non-channel side of a first plate;

a cover plate in sealing contact with the channel side of an external first or second plate; and a micro-turbine disposed within one of the contiguous channels.

* * * * *